US008820338B1

(12) United States Patent
Catricala et al.

(10) Patent No.: US 8,820,338 B1
(45) Date of Patent: Sep. 2, 2014

(54) WALKER FOR IMPROVED STAIRWAY MOBILITY

(76) Inventors: Thomas Catricala, Wethersfield, CT (US); Benjamin Grant, Wethersfield, CT (US); Griffin Latulippe, Wethersfield, CT (US); Alexander Mutchler, Wethersfield, CT (US); Purven Parikh, Wethersfield, CT (US); Charles Persaud, Wethersfield, CT (US); Matthew Wilson, Wethersfield, CT (US); Matthew Thomas, Wethersfield, CT (US); Jeffrey Epp, Wethersfield, CT (US)

( * ) Notice: Subject to any disclaimer, the term of this patent is extended or adjusted under 35 U.S.C. 154(b) by 254 days.

(21) Appl. No.: 13/306,098

(22) Filed: Nov. 29, 2011

Related U.S. Application Data

(60) Provisional application No. 61/423,338, filed on Dec. 15, 2010.

(51) Int. Cl.
*A61H 3/00* (2006.01)
*A45B 9/00* (2006.01)

(52) U.S. Cl.
USPC ..... 135/75; 135/67

(58) Field of Classification Search
CPC ..... A45B 2009/007
USPC ..... 135/65, 66, 67, 75
See application file for complete search history.

(56) References Cited

U.S. PATENT DOCUMENTS

| | | | | |
|---|---|---|---|---|
| 3,800,815 | A | 4/1974 | Birk | |
| 5,349,977 | A | 9/1994 | Wood | |
| 5,411,044 | A * | 5/1995 | Andolfi | 135/66 |
| 5,649,558 | A | 7/1997 | Richard | |
| 5,853,015 | A * | 12/1998 | Evans | 135/67 |
| 6,145,524 | A * | 11/2000 | Li et al. | 135/67 |
| 6,453,921 | B1 | 9/2002 | Rost | |
| 2012/0298160 | A1 * | 11/2012 | Hamilton | 135/66 |

* cited by examiner

*Primary Examiner* — David R Dunn
*Assistant Examiner* — Danielle Jackson
(74) *Attorney, Agent, or Firm* — Uconn IP Law Clinic; Robert S. Smith; Matthew Seward

(57) ABSTRACT

A walker adapted to navigate stairways and inclined surfaces is provided.

4 Claims, 3 Drawing Sheets

WALKER FOR IMPROVED STAIRWAY MOBILITY

This application claims priority from provisional application No. 61/423,338 filed Dec. 15, 2010, which application is incorporated herein by reference in its entirety.

FIELD OF THE INVENTION

The present invention relates to ambulatory assistance devices or walkers and more specifically to walkers adapted for use on inclined surfaces or stairs.

BACKGROUND OF THE INVENTION

Ambulatory assistance devices are well known and are designed in various forms including canes, walkers, wheelchairs, and the like. Regardless of the form, each device seeks to replace a function that a healthy individual is able to perform but which is impossible or difficult for the user of the device.

Conventional walkers consist primarily of a frame comprising four legs which are stabilized by crossbars. Conventional walker frames come in a variety of shapes and sizes; many consist primarily of two inverted U-shaped leg modules connected by crossbars. The frame of conventional walkers is composed of lightweight materials, such as aluminum. Regardless of the shape or form of the leg modules, each walker frame forms a 3-sided box with an opening in which the user may stand. The frame often includes two handles located on each side of the user at the upper region of each inverted U-shaped member. The handles are often cushioned and are ideally positioned at a height that allows the user to grasp the handles for a secure grip.

Conventional walkers are well known to include mechanical means to allow the length of the legs to be increased or decreased. Many walkers provide this functionality through the incorporation of a number of holes aligned symmetrically along the lower ends of each of the legs of the walker. Fasteners are used to secure the walker at a desired height. These fasteners are rarely adjusted, typically once for each individual user. The adjustment is a time-consuming process requiring significant dexterity.

Conventional walkers are not well suited or intended for use on stairways or inclined surfaces. The inability of conventional walkers to properly balance on such surfaces limits their usefulness and may introduce significant risk to the user. There exists a need for a walker that affords the user stability, control, and ease of use for navigating inclined surfaces and stairways.

SUMMARY OF THE INVENTION

The present invention is a walker with improved stability on inclined surfaces and stairways.

In one embodiment of the present invention, a walker is provided that includes mechanically-driven front legs that may be conveniently extended or retracted by the user during use. The walker includes two vertical, substantially parallel U-shaped leg modules. Each leg module comprises a horizontal handle at or near the top section of the leg module and a front and rear leg. Each front and rear leg comprises an upper section and a lower section, the lower section of each leg having a diameter slightly smaller than the diameter of the upper section of the leg and being partially contained within the upper section. The upper sections of the legs are connected by a plurality of substantially horizontal struts that give the walker substantial support and rigidity. The leg modules and struts are so arranged as to permit the user to stand between the leg modules.

A linear actuator is connected via fastening means to each front leg. Each linear actuator comprises an upper section and a lower section. Each upper section comprises a rotatable, threaded drive rod. The lower section of each linear actuator contains a fixed threaded nut threaded on said drive rod. The upper section and lower section of each linear actuator are attached to the upper section and lower section respectively of the appropriate front leg. The walker also includes a motor capable of rotating the drive rods coupled to the linear actuators and a control means for activation of the motor. When the motor is activated, it rotates the drive rods, which in turn causes the fixed nuts to move up or down the drive rod and retract or extend the front legs.

The drive rod of each linear actuator may be rotated by the user via the motor control to extend or retract the front legs by means of the linear actuators. The control means may be a double pull double throw switch or other conventional control means. Each front leg will extend or retract at a substantially identical rate. In typical use for ascending an inclined surface or stairway, the user will advance the walker to an inclined surface or first step of a set of stairs. The user will then shorten the front legs of the walker through the use of the control switch. The user can then place the walker such that the front legs are situated on the incline or the first step of the stairway while the rear legs remain at ground level. The handles of the walker remain substantially horizontal due to the shortening of the front legs. After the user ascends the first part of the incline or the first step, the walker can be easily placed farther up the incline or on the next step. This process is repeated until the user reaches the end of the incline or stairway. The user then activates the control switch to extend the front legs until they are substantially the same length as the rear legs. A substantially identical process may be used for moving down on inclined surfaces or stairways except that the front legs are lengthened instead of shortened.

In another embodiment of the present invention, a walker is provided with mechanically-driven front and rear legs that extend through the use of four linear actuators. The front legs of the walker extend and retract as provided in the previous embodiment of the invention. The rear legs may also have linear actuators similarly arranged to those on the front legs that extend and retract the rear legs via a control means. The control means for the rear legs may be located separate from the control means for the front legs or, alternatively, on a shared location. The rear legs may extend or retract independent of the front legs.

In yet another embodiment of the present invention, a walker is provided with mechanically-driven front and rear legs. The walker is similar to that described in the preceding embodiment. The walker further comprises the ability, via user control means, to enter a mode in which the front and rear legs extend and retract at substantially the same rate, thereby changing the height of the walker while all four legs remain at substantially the same length relative to each other. In this embodiment, a single walker may easily be used by people of different heights and thereby easily accommodate multiple users.

DETAILED DESCRIPTION OF THE INVENTION

Figure 1:
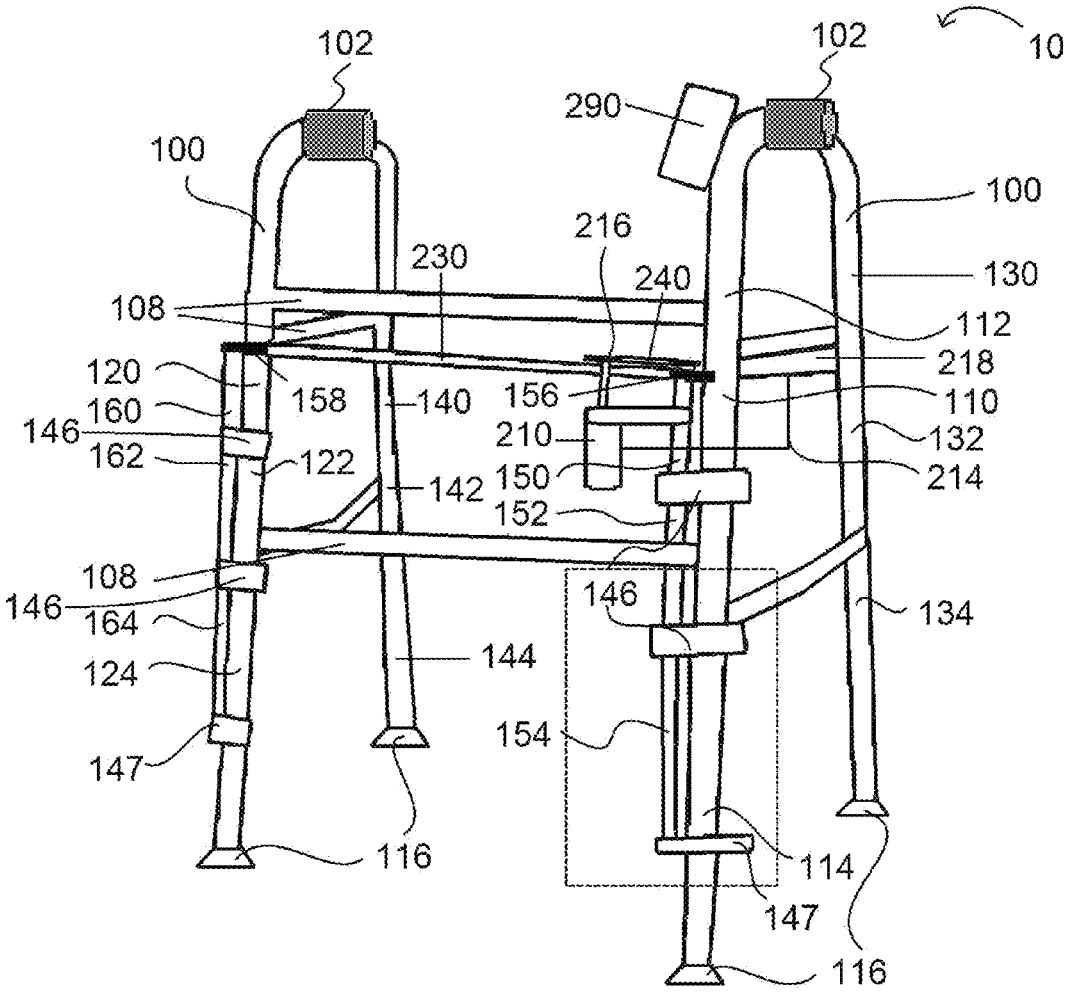
FIG. 1 is a perspective view of an exemplary embodiment of the invention.

Referring to the drawings, FIG. 1 shows a walker frame 10 in which the user (not shown) stands between two substantially parallel U-shaped leg modules 100. The walker frame 10 is composed of metal, plastic, or other suitable material and is self-supporting. The walker frame 10 may include handles 102 located on or near the highest point of the frame 10, and horizontal crossbar struts 108. Each handle 102 is attached to the upper section of one leg module 100. Crossbar struts 108 support the walker frame 10 and provide it with stability. The feet of the walker may comprise wheels (not shown) or rubber feet 116 or other mechanisms known in the art to aid in the stabilization or leveling of the walker.

The walker includes a pair of tubular front legs (110, 120), each comprising an upper section (112, 122) and a lower section (114, 124). The diameter of each lower section (114, 124) of each front leg (110, 120) is slightly smaller than the diameter of the respective upper section (112, 122) and is partially contained within it. The lower section (114, 124) of each front leg (110,120) is thus able to slideably retract within the respective upper section (112, 122). The walker also includes a pair of tubular rear legs (130, 140) each of which comprises an upper section (132, 142) and a lower section (134, 144) and which remain substantially fixed when the walker is in use. As for the front legs, the lower section of each rear leg (130, 140) is of slightly smaller diameter than the respective upper section (112, 122) and partially contained within it. The height of the rear legs (130, 140) may be adjusted prior to use by extending or retracting the lower leg sections by means well-known in the art. The rear legs (130, 140) maintain their height through the use of fastening means that are well known in the art such as a series of holes and load-bearing protrusions (not shown).

Still referring to FIG. 1, a linear actuator (150, 160) is mounted substantially parallel to each front leg (110, 120). Each linear actuator (150, 160) comprises an upper section (152, 162) and a lower section (154, 164). The upper section (152, 162) of each linear actuator (150, 160) is connected to the upper section of the corresponding front leg with a bracket 146 or other fastening means. Each lower section (154, 164) is connected to the lower section (114, 124) of the corresponding front leg (110, 120) with a bracket 146 or other fastening means. The brackets (146, 147) are sufficiently secure to provide stability when the legs are extended or retracted. The upper and lower sections of each linear actuator (150, 160) may be tubular and the diameter of each lower section (154, 164) slightly smaller than the diameter of the respective upper section (152, 162) and partially contained within it so that each lower section (154, 164) is able to slideably retract within the respective upper section (152, 162).

The upper section (152, 162) of each linear actuator (150, 160) includes a pulley gear (156, 158) attached to a threaded drive rod (not shown). The pulley gears (156, 166) are coupled by a drive belt 230 so that they rotate in concert with each other. The upper section (152, 162) of each linear actuator (150, 160) comprises the threaded drive rod (not shown) and the lower section (154, 164) of each linear actuator (150, 160) contains a fixed threaded nut (not shown) threaded onto the drive rod (not shown).

The drive belt 230 is connected to the pulley gears (156, 158) and linked with the motor gear 216. When activated by the double pull double throw switch 290, rotation of the motor gear 216 causes rotation of pulley gear 156 through movement of the motor belt 240 and (through drive belt 230) pulley gear 158. The speed of leg extension and retraction is determined in part by the ratio of the diameter of motor gear 216 to the diameter of pulley gears (156, 158). In an exemplary embodiment, the ratio of the diameter of motor gear 216 to the diameter of pulley gears (156, 158) is 1.6:1. The use of smaller pulley gears (156, 158) increases the speed of leg extension or retraction.

Figure 2:
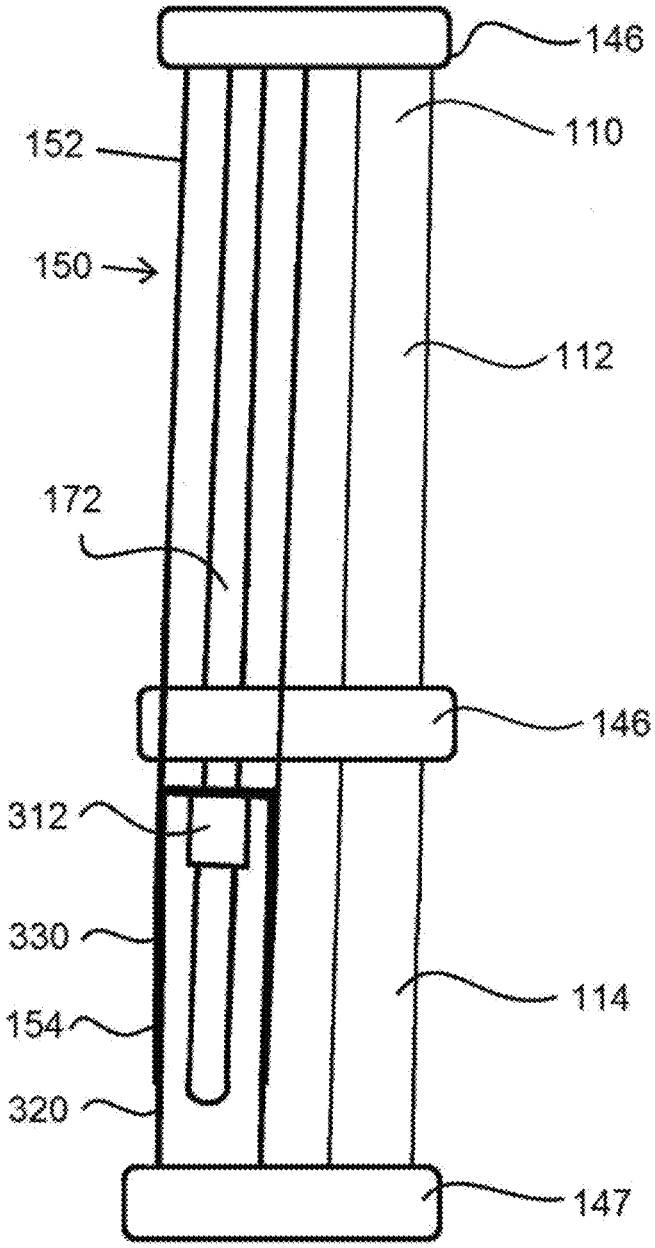
FIG. 2 is a detailed view of a linear actuator.

FIG. 2 shows the detailed operation of a representative linear actuator 150. The linear actuator 150 comprises an upper section 152 attached to the upper section 112 of leg 110 by brackets 146 and having a threaded drive rod 172 rotatably attached thereto, a lower section 154 attached to the lower section 114 of leg 110 by a lower bracket 147, said lower section 154 of linear activator 150 comprising a fixed internal nut 312 affixed thereto such that when the motor (not shown) is activated, the threaded drive rod 172 rotates, inducing the nut 312 to travel along the drive rod 172 in a substantially vertical direction either up or down, depending on the direction of rotation of the threaded drive rod 172. The travel of the nut 312 along the threaded drive rod 172 causes the lower section 154 of the linear actuator 150 to extend or retract, thus causing the lower section 114 of leg 110 to extend or retract and increasing or decreasing the length of the leg. In this embodiment, the linear actuator 150 also comprises a lower cover section 320 and an upper cover section 330 which are tubular and contain the drive rod 172 and the fixed nut 312. The diameter of the lower cover section 320 is smaller than the diameter of the upper cover section 330 and slideably contained therein. The configuration for leg 120 and corresponding linear actuator 160 is substantially identical to that of leg 110 and linear activator 150. Activating the switch will therefore extend or retract the front legs (110, 120) to a substantially equal extent. The front legs (110, 120) will remain stable and locked in place when the switch is at rest. Further, moderate pressure can remain on the legs continuously during the extension or retraction process without affecting the stability of the walker.

Figure 3:
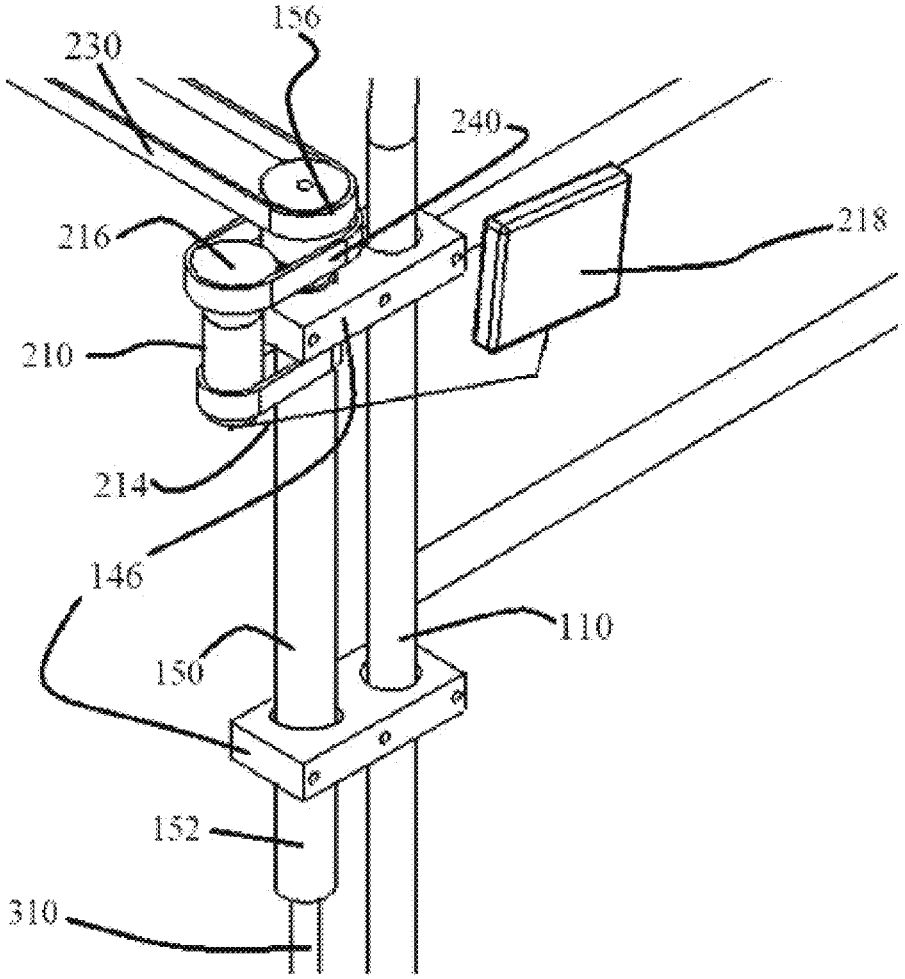
FIG. 3 is a photograph of a linear actuator in an embodiment of the invention.

Referring now particularly to FIG. 3, motor 210 is powered by a battery, (not shown) housed in battery pouch 218, electrically connected to motor 210 via battery wiring 214. Motor gear 216 is connected to pulley gear 156 via a motor belt 240. Drive belt 230 connects pulley gear 156 and the pulley gear (not shown) of the other front leg (not shown). Bracket 146 secures the upper section (152) of the linear actuator 150 to front leg 110. Lower bracket 147 connects the lower section of the linear actuator to the lower section of the front leg. When motor 210 is activated, it causes rotation of pulley gear 156 by movement of motor belt 240, thus causing rotation of threaded drive rod 310. Referring back to FIG. 2, the rotation of threaded drive rod 310 causes nut 312 to travel up or down the threaded drive rod 310 thus causing extension or retraction of the front leg 110. In a corresponding fashion, the rotation of pulley gear 158 (as shown in FIG. 1) causes extension or retraction of corresponding front leg 120.

In another embodiment of the invention, a second pair of linear actuators substantially similar to those present on the front legs are attached to the rear legs to enable motorized rear leg extension or retraction.

We claim:

1. A walker adapted to navigate stairways and inclined surfaces comprising:

a) two substantially parallel U-shaped leg modules, each leg module comprising;
   a substantially horizontal handle; and a front and rear leg, each front leg having a tubular upper section and a tubular lower section, the diameter of each said lower section being smaller than the diameter of the corresponding upper section and being partially slideably contained therein;

b) a plurality of substantially horizontal struts fastening the leg modules together;

c) two substantially vertical linear actuators each comprising an upper section and a lower section, each upper section having a rotatable, threaded drive rod and each corresponding lower section having a fixed threaded nut threaded on said drive rod, the upper section of each linear actuator being attached to the upper section of one front leg and the lower section of each linear actuator being attached to the lower section of the same front leg;

d) an electric motor coupled to and capable of rotating the drive rods of said linear actuators; and e) a control for activating said electric motor;

whereby activation of said electric motor causes rotation of said drive rods, which in turn causes extension or retraction of the front leg sections of the leg modules substantially in concert, wherein each of said linear actuators comprises a tubular upper cover section and a tubular lower cover section, the diameter of each said lower cover section being smaller than the diameter of the corresponding upper cover section and being partially slideably contained therein;

the threaded drive rod is contained within the upper cover section and the threaded nut is attached to the lower cover section;

the upper cover section of each linear actuator is attached to the upper section of one front leg and the corresponding lower cover section of said linear actuator is attached to the lower section of said front leg;

whereby, as said nut travels along the threaded drive rod when the motor is engaged, such travel in turn causes the lower cover section to extend or retract thus extending or retracting the front legs.

2. The walker of claim 1, wherein each rear leg has a tubular upper section and a tubular lower section, the diameter of each said lower section being smaller than the diameter of the corresponding upper section and being partially slideably contained therein and further comprising a linear actuator mechanically connected to said upper and lower sections of each rear leg and being capable of extending or retracting said rear legs.

3. The walker of claim 2, which further comprises a rear leg control means comprising a double pole double throw switch which is electrically connected to the motor to allow a user to activate the motor to extend or retract the rear legs.

4. The walker of claim 1, wherein a front leg control means comprising a double pole double throw switch is electrically connected to the motor to allow a user to activate the motor to extend or retract the front legs.

* * * * *